US005135050A

United States Patent [19]

Tailby

[11] Patent Number: 5,135,050

[45] Date of Patent: Aug. 4, 1992

[54] DEVICE FOR COLLECTING PARTICULATE MATTER AND DEBRIS IN HORIZONTAL OR HIGH-DEVIATION OIL OR GAS WELLS

[75] Inventor: Roger Tailby, Ålgård, Norway

[73] Assignee: Den Norske Stats Oljeselskap A. S, Stavanger, Norway

[21] Appl. No.: 689,512

[22] Filed: Apr. 23, 1991

[51] Int. Cl.[5] ..... E21B 31/08

[52] U.S. Cl. ..... 166/99; 166/311; 175/308

[58] Field of Search ..... 175/20, 226, 308; 166/311, 99

[56] References Cited

U.S. PATENT DOCUMENTS

| | | | |
|---|---|---|---|
| 3,589,442 | 6/1971 | Kilgore | 166/311 X |
| 3,831,680 | 8/1974 | Edwards et al. | 166/311 |
| 4,749,044 | 6/1988 | Skipper et al. | 166/301 X |
| 4,828,026 | 5/1989 | Nelson | 166/99 |

*Primary Examiner*—Terry Lee Melius
*Attorney, Agent, or Firm*—Foley & Lardner

[57] ABSTRACT

Device for collecting particulate matter and debris in horizontal or highly-deviated oil or gas wells, comprising a cylindrical housing (10) enclosing a collecting chamber having at least one radial port (7A, B) at a distance from an inner end (5) of said chamber (1), and a piston-like sleeve (3) normally and in a starting position closing said port(s). Releasable means (9) retain said sleeve (3) in said starting position and a spring (8) urges said sleeve (3) towards said starting position. The sleeve (3) has a central axial opening (3D) as well as a differential area (3C) exposed to the pressure outside said chamber (1) in said normal or starting position, whereby upon releasing of said releasable means (9) said outside pressure will move said sleeve (3) towards said inner end (5) of the chamber (1) and open said port(s) (7A, B) so as to collect a quantity of said matter and debris in the chamber.

8 Claims, 1 Drawing Sheet

DEVICE FOR COLLECTING PARTICULATE MATTER AND DEBRIS IN HORIZONTAL OR HIGH-DEVIATION OIL OR GAS WELLS

This invention relates to a collecting device, so-called hydrostatic bailer, for collecting particulate matter and debris in horizontal or highly-deviated oil or gas wells. This type of device serves to retrieve particulate matter and debris from a downhole zone to the surface, and comprises a cylindrical housing enclosing a collecting chamber and means for opening and closing that chamber respectively, during a collecting operation downhole.

For operation in vertical oil or gas wells such collecting devices are known and these are based upon an in-surge effect caused by a differential pressure between the outside and the inside of the device, in order to collect particulate matter and debris from the bottom of a well.

In the case of horizontal or highly-deviated wells, however, the problems of such operations are quite different and more complex.

Thus, the present invention is directed to a device being particularly designed for use during annulus-circulation pumpdown operations in the servicing of horizontal or highly-deviated wells in order to clean the hole of obstructing particulate debris like sand, rust particles and baryte. In such wells and operations these obstructing particles cannot be circulated out like in conventional operations through the flow-line, because the fluid return would be up through the annulus between the tubing and the well casing. A highly-deviated well in this context may be one having a deviation of significantly more than 60° from the vertical. At such high deviations or in approximately horizontal wells the debris concerned is assumed to be lying along the low side of the hole for a considerable length. This is a situation quite different from what is found in vertical wells.

The collecting device to be described here has been developed for use in a pumpdown toolstring as described in co-pending U.S. patent application No. 07/689,547 (Sak 18 - Coiled Tubing), but it will be understood that the present device can also be used in other combinations or types of toolstrings.

The novel and specific features of the device according to the invention are stated in the claims.

Figure 1:
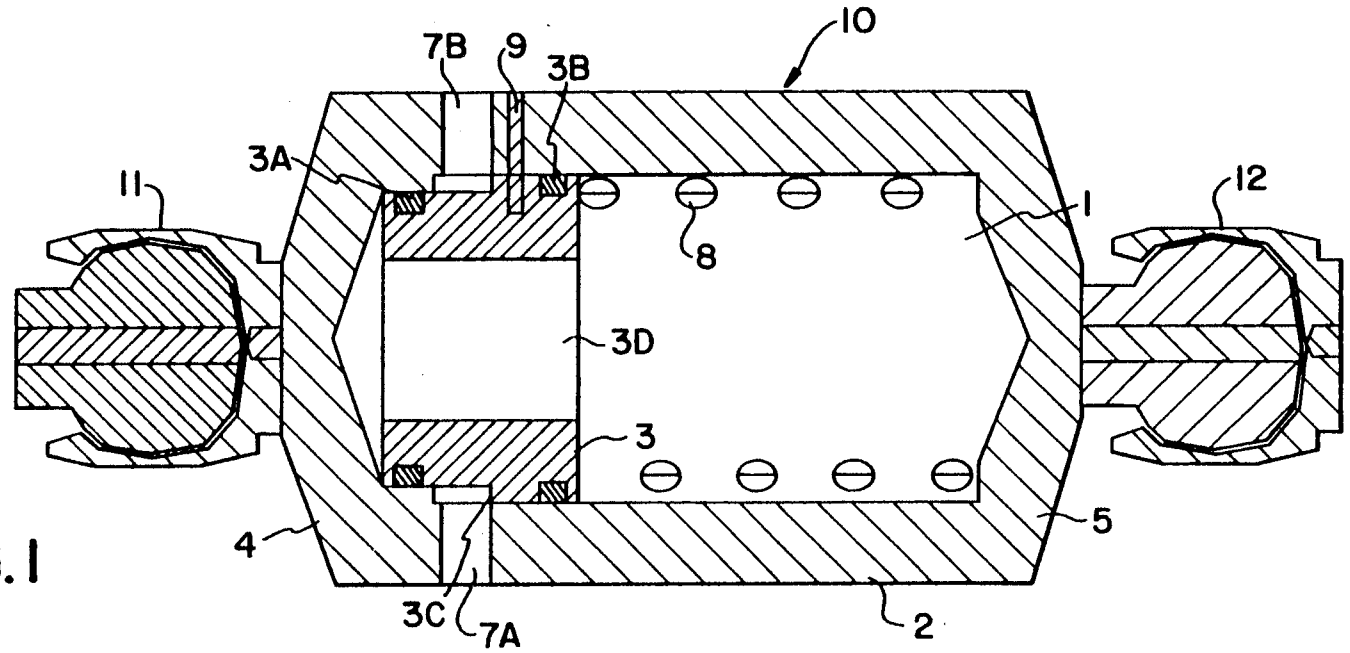
Figure 2:
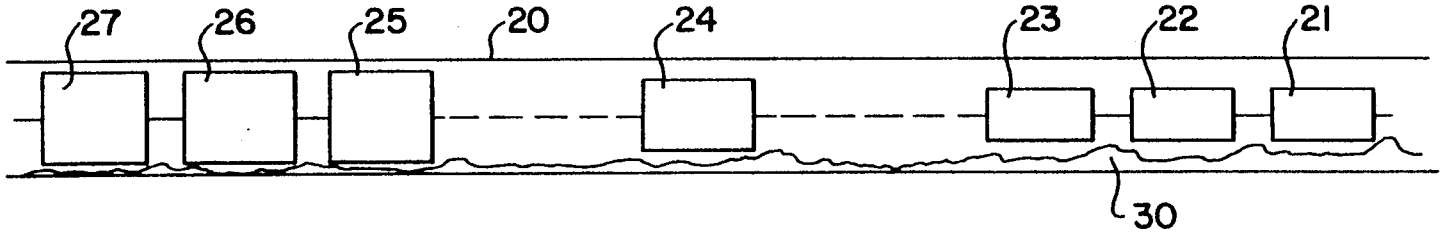

In the following description this device as well as advantages obtained therewith, are explained with reference to the drawings, of which:

FIG. 1 is an axial section through an exemplary embodiment of the device according to the invention, and FIG. 2 schematically illustrates a series of such devices coupled together for performing particle collection over a length of horizontal tubing.

The device shown in FIG. 1 comprises a cylindrical housing 10 enclosing a chamber 1 within which the particulate matter or debris concerned, is to be collected. Coupling means 11 and 12 at either end of housing 10 serve to connect this collecting device to other devices of the same kind or to other types or tool units in a toolstring for performing operations within horizontal highly-deviated wells.

In the cylindrical wall 2 of housing 10 radial ports 7A and 7B are provided adjacent one end of the housing. This end, which has an end wall 4, may be considered to be an outer end of the chamber 1, whereas the opposite end with end wall 5, may be considered as an inner end of the chamber.

The piston-like sleeve 3 with a central through-opening 3D is shown in a normal or starting position within the chamber 1, in which position the sleeve 3 is held by means of a shear pin 9 inserted in bores through the housing wall 2 and into the sleeve 3. In this position the sleeve 3 closes ports 7A and 7B thereby maintaining an initial pressure within chamber 1, this pressure being usually the atmospheric pressure at the surface, from which such a device is transported down and into the well zone to be cleaned.

It is to be noted that sleeve 3 has a larger diameter portion 3B and a reduced diameter portion 3A, each being provided with seals so as to obtain a sufficient degree of fluid tightness against surrounding chamber wall portions. A step 3C running round the circumference of sleeve 3 separates between said larger and reduced diameter portions 3B and 3A, and plays an important role in the function of the sleeve in the chamber 1. As will be understood from the following explanation of the function of step 3C, this may have other shapes than the one illustrated in FIG. 1, i.e. a more or less conical shape.

In addition to the elements mentioned, there is provided a helical spring 8 in chamber 1 between the inner end 5 thereof and sleeve 3. Thus, spring 8 being a compression spring, has the effect of urging sleeve 3 towards the left in FIG. 1, i.e., to the normal or starting position of the sleeve.

The step 3C forms a differential area which is exposed to the pressure outside chamber 1 and housing 10 through the radial ports 7A and 7B. When from the surface and through the tubing this outside pressure is increased above a predetermined magnitude sleeve 3 will be released for movement by the breaking of the shear pin 9. Sleeve 3 will then move towards the inner end 5 of the chamber 1 and the ports 7A and 7B will be uncovered and well fluids will be allowed to flow quickly into the chamber 1. This rapid flow or surge is able to draw any solids or particles in the vicinity into the chamber.

This inflow or insure into chamber 1 will soon result in a pressure equalization, whereupon spring 8 will return sleeve 3 to its original or normal position covering the radial ports 7A and 7B. Then the captured solids or debris are retained in chamber 1 during retrieval to the surface.

Two radial ports 7A and 7B are shown in FIG. 1, but it will be obvious that also other numbers of ports may be used, even a single port, which will have to be oriented substantially downwards within the circular tubing cross-section. More preferably, the number of radial ports is higher than two, such as 6 to 8 ports altogether distributed around the circumference of housing 10.

Ports 7A and 7B in the embodiment of FIG. 1 are located close to the outer end 4 of chamber 1. This is an advantage among other things in view of the required axial movement of sleeve 3 when released, since this sleeve should be moved at least such a distance into chamber 1 that the rear end of the sleeve is completely uncovering the ports. There may also be another reason for locating the ports adjacent an end of housing 10, i.e., a housing end being the foremost or leading during movements of the device just before or when a collecting operation takes place. As will be explained further with reference to FIG. 2, movement of one or more collecting devices within tubing containing particulate debris will to some extent push these particles into small heaps in front of each device. Thus, the device in FIG. 1 with the location of ports 7A and 7B shown, should preferably be adapted to be moved in a direction to the left in FIG. 1 in connection with a collecting operation.

The increased outside pressure mentioned above serving to release the shear pin locking of sleeve 3, may be of a magnitude substantially exceeding the pressure normally existing at the position concerned within a well. Normal pressures may be for example 300 to 400 bar, and the pressure increase brought about from the surface may be of the order of magnitude 60 to 100 bar, and the total pressure during such increase may even be as much as 600 to 700 bar. Such pressure variations induced from the surface are quite common procedures in oil or gas wells, and the degree of pressure increase should be large enough to take into account any inaccuracy in the shear pin break limit. Only one shear pin 9 is shown in FIG. 1, but it will be understood that in some cases several shear pins around the periphery of housing 10 may be used.

Initially before starting a toolstring operation this collecting device or tool is basically an empty chamber 1, i.e., being empty in the meaning that atmospheric pressure is existing in the chamber. As an alternative, the chamber may be filled with nitrogen gas at high pressure such that weaker shear pins may be used to constrain the piston. The resulting shock when these pins shear will thereby be less.

Whereas wireline bailing or debris collection is performed in a vertical or slightly deviated well, where the solids are found at the bottom of the well only, the solids in a horizontal highly-deviated well are likely to be distributed along the low side of the well cross-section and in shallow dunes or heaps.

According to the invention as illustrated in FIG. 2, an assembly of a number of collecting devices 21 to 27 of various diameters may be run simultaneously. The number of devices in such an assembly may be for example from ten to twenty, and groups of three, four or five successive devices may be of the same diameter. Thus, in FIG. 2 devices 21, 22 and 23 have a comparatively small diameter, whereas at the opposite end of this assembly devices 25, 26 and 27 have a comparatively large diameter. Intermediate devices, such as device 24, may have an intermediate size. When running such an assembly through a tubing 20 having solid particles or debris 30 at its bottom, the direction of movement is to the right in FIG. 2, which means that the smaller diameter devices 21, 22 and 23 are at the leading end of the assembly. These leading devices 21, 22, 23 therefore are able to collect a first proportion of such debris and then leaving a gradually diminishing amount of debris for collection by the following and trailing devices 25, 26 and 27.

Also illustrated in FIG. 2 is the tendency of heaps accumulating in front of each collecting device, when the direction of movement of the assembly is considered to be towards the right in FIG. 2. Under these circumstances the radial ports (7A and 7B in FIG. 1) would preferably be located at the leading (right) end of each of the devices 21 to 27 shown in FIG. 2.

The device of FIG. 1 should be provided with a bleed port (not shown) to make possible pressure relief at the surface so as to ensure personnel safety while handling a full collecting device returned to the surface from a well. Such a bleed-off port is not shown in FIG. 1, but is well known in similar devices.

Also other modifications may be possible, such as giving the ports 7A and 7B an elliptical cross-section or to arrange two oppositely acting sleeves 3 in each chamber 1. In addition, it may be found to be convenient to rearrange the opening mechanism such that compression of the toolstring breaks the shear pins and allows influx of fluid and debris.

I claim:

1. Device for collecting particulate matter and debris in horizontal or highly-deviated oil or gas wells, in order to retrieve said particulate matter and debris to the surface, comprising a cylindrical housing (10) enclosing a collecting chamber and means for opening and closing said chamber respectively, during a collecting operation downhole, characterized by at least one radial port (7A, B) at a distance from an inner end (5) of said chamber (1), a piston-like sleeve (3) normally and in a starting position closing said port(s) and in said starting position serving to substantially maintain an initial pressure in said chamber, releasable means (9) for retaining said sleeve (3) in said starting position, a spring (8) within said chamber (1) for urging said sleeve (3) towards said starting position, said sleeve (3) having a central axial opening (3D) as well as a differential area (3C) exposed to the pressure outside said chamber (1) in said normal or starting position, whereby upon releasing of said releasable means (9) said outside pressure will move said sleeve (3) towards said inner end (5) of the chamber (1) and open said port(s) (7A, B) for a sudden in-surge provided for by the pressure difference between said outside pressure and said initial pressure in the chamber, so as to collect a quantity of said matter and debris in the chamber, and reverse movement of said sleeve (3) is provided for by said spring (8) when said pressure difference is substantially equalized.

2. Device according to claim 1, characterized in that at least two and preferably 6–8 radial ports (7A, B) are provided at uniform angular distribution around the periphery of said housing (10).

3. Device according to claim 1, characterized in that said port(s) (7A, B) is (are) located close to an outer end (4) of said chamber (1) remote from said inner end (5) of the chamber.

4. Device according to claim 1, characterized in that said port(s) (7A, B) is (are) located close to an end (4) of said chamber corresponding to a foremost end during movement of the device just before or when said collecting operation takes place.

5. Device according to claim 1, characterized in that said sleeve (3) has a larger diameter portion (3B) and a reduced diameter portion (3A), said reduced diameter portion being adapted to face said port(s) (7A, B) in said normal or starting position, and said differential area (3C) is formed at the junction between said larger diameter portion (3B) and said reduced diameter portion (3A).

6. Device according to claim 1, characterized in that said releasable means comprise at least one shear pin (9) extending from a housing wall (2) into said sleeve (3) and being adapted to break upon exertion of an outside pressure exceeding a predetermined magnitude.

7. Device according to claim 1, characterized in that said initial pressure is adapted to be approximately atmospheric pressure.

8. An assembly of a number of at least two devices according to claim 1, characterized in that one or more leading devices (21–23) have a smaller housing outside diameter than one or more trailing devices (24–27) in the assembly.

* * * * *